US006871523B2

(12) United States Patent
Ishizuka et al.

(10) Patent No.: US 6,871,523 B2
(45) Date of Patent: Mar. 29, 2005

(54) METHOD AND APPARATUS FOR FORMING MICROCHANNELS IN A FILAMENT WIRE

(75) Inventors: Makoto Ishizuka, Osaka (JP); Daniel Hogan, Acton, MA (US); Kazuaki Ohkubo, Takatsuki (JP); Mitsuhiko Kimoto, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 13 days.

(21) Appl. No.: 10/403,568

(22) Filed: Mar. 31, 2003

(65) Prior Publication Data

US 2004/0187539 A1 Sep. 30, 2004

(51) Int. Cl.[7] ..... B21C 1/04; B21C 9/00
(52) U.S. Cl. ..... 72/282; 72/286
(58) Field of Search ..... 72/282, 286, 274, 72/276

(56) References Cited

U.S. PATENT DOCUMENTS 2,036,034 A * 3/1936 Fulmer et al. ..... 29/417
2,250,610 A * 7/1941 Simons ..... 72/64
3,713,323 A * 1/1973 Ivanier ..... 72/467
4,291,444 A 9/1981 McCarty et al.
4,292,826 A * 10/1981 Langenecker ..... 72/45
4,440,729 A 4/1984 Jonsson
5,389,853 A 2/1995 Bigio et al.

FOREIGN PATENT DOCUMENTS

FR 421012 * 2/1911 ..... 72/286
JP 84818 * 4/1987 ..... 72/274

* cited by examiner

*Primary Examiner*—Daniel C. Crane
(74) *Attorney, Agent, or Firm*—RatnerPrestia

(57) ABSTRACT

A microchannel forming device is provided for making microchannels in a wire. The microchannel forming device includes a plurality of dice for receiving a heated wire spaced along a longitudinal axis. Each die has a circumferential surface forming an opening, and teeth projecting normally from the surface and terminating in the opening. As the heated wire is drawn through the opening of each die, the teeth engage the heated wire to form longitudinal microchannels therein.

16 Claims, 5 Drawing Sheets

METHOD AND APPARATUS FOR FORMING MICROCHANNELS IN A FILAMENT WIRE

FIELD OF THE INVENTION

This invention relates to forming microchannels in filament wires to improve their radiative efficiency. More particularly, this invention relates to a device and method for forming microchannels in a filament wire suitable for mass manufacturing environments.

BACKGROUND OF THE INVENTION

The cost of producing and purchasing electricity has escalated to all-time highs worldwide. This is especially true in under-developed countries where electricity supply is limited, as well as in those countries with large populations where the demand for electricity is high. Driven by this demand is an ever-increasing desire to produce lighting sources that are energy efficient and minimize the cost of electric usage.

Over the past two centuries, scientists and inventors have strived to develop a cost-effective, practical, long-life incandescent light bulb. Developing a long-life, high-temperature filament is a key element in designing a practical incandescent light bulb.

Tungsten filaments have been found to offer many favorable properties for lighting applications, such as a high melting point (3,410° C./6,170° F.), a low evaporation rate at high temperatures (10–4 torr at 2,757° C./4,995° F.), and a tensile strength greater than steel. These properties allow the filament to be heated to higher temperatures to provide brighter light with favorable longevity, making tungsten a preferred material for filaments in commercially available incandescent light bulbs.

The filament of an incandescent lamp emits visible and non-visible radiation when an electric current of sufficient magnitude is passed through it. The filament emits, however, a relatively small portion of its energy, typically 6 to 10 percent, in the form of visible light. Most of the remainder of the emitted energy is in the infrared region of the light spectrum and is lost in the form of heat. As a consequence, radiative efficiency of a typical tungsten filament, measured by the ratio of power emitted at visible wavelengths to the total radiated power over all wavelengths, is relatively low, on the order of 6 percent or less.

Conventional techniques for increasing the amount of visible light emitted by an incandescent filament rely on increasing the amount of energy available from the filament by increasing the applied electrical current. Increasing the current, however, wastes even larger amounts of energy. What is needed is a tungsten filament that emits increased visible light, without increasing energy consumption.

Another concern is the life span of a filament. A tungsten filament is very durable, but after a prolonged period of time large electrical currents cause excessive electron wind, which occurs when electrons bombard and move atoms within the filament. Over time, this effect causes the filament to wear thin and eventually break.

It has been observed that the radiative efficiency of filament material such as tungsten may be increased by texturing the filament surface with submicron sized features. A method of forming submicron features on the surface of a tungsten sample using a non-selective reactive ion etching technique is disclosed by H. G. Craighead, R. E. Howard, and D. M. Tennant in "Selectively Emissive Refractory Metal Surfaces," 38 Applied Physics Letters 74 (1981). Craighead et al. disclose that improved radiative efficiency results from an increase in the emissivity of visible light from the tungsten. Emissivity is the ratio of radiant flux, at a given wavelength, from the surface of a substance (such as tungsten) to radiant flux emitted under the same conditions by a black body. The black body assumes to absorb radiation incident upon it.

Craighead et al. disclose that the emissivity of visible light from a textured tungsten surface is twice that of a non-textured surface, and suggest that the increase is a result of more effective coupling of electromagnetic radiation from the textured tungsten surface into free space. The textured surface of the tungsten sample disclosed by Craighead et al. has depressions in the surface separated by columnar structures projecting above the filament surface by approximately 0.3 microns.

Another method for enhancing incandescent lamp efficiency by modifying the surface of a tungsten lamp filament appears in a paper entitled "Where Will the Next Generation of Lamps Come From?", by John F. Waymouth, pages 22–25 and FIG. 20, presented at the Fifth International Symposium on the Science and Technology of all Light Sources, York, England, on Sep. 10–14, 1989. Waymouth hypothesizes that filament surface perforations measuring 0.35 microns across, 7 microns deep, and separated by walls 0.15 microns thick, may act as waveguides to couple radiation in the visible wavelengths between the tungsten and free space, but inhibit emission of non-visible wavelengths. Waymouth discloses that the perforations on the filament may be formed by semiconductor lithographic techniques, but such perforation dimensions are beyond current state-of-the-art capabilities.

Another method for reducing infrared emissions of an incandescent light source is described in U.S. Pat. No. 5,955,839 issued to Jaffe et al. As described, the presence of microcavities in a filament provides greater control of directivity of emissions and increases emission efficiency in a given bandwidth. Such a light source, for example, may have microcavities between 1 micron and 10 microns in diameter. While features having these dimensions may be formed in some materials using microelectronic processing techniques, it is difficult to form them in metals, such as tungsten, commonly used for incandescent filaments.

Yet another method for reducing infrared emissions of an incandescent light source is disclosed in U.S. Pat. No. 6,433,303 issued to Liu et al. entitled Method and Apparatus Using Laser Pulses to Make an Array of Microcavity Holes. The method disclosed uses a laser beam to form individual microcavities in a metal film. An optical mask divides the laser beam into multiple beams and a lens system focuses the multiple beams onto the metal film and forms the microcavities.

Still another method is disclosed in U.S. Pat. No. 5,389,853 issued, to Bigio et al., and describes a filament having improved emission of visible light. The emissivity of the tungsten filament is improved by depositing a layer of submicron-to-micron crystallites on its surface. The crystallites are formed from tungsten, or a tungsten alloy of up to 1 percent thorium and up to 10 percent of at least one of rhenium, tantalum, and niobium.

While these conventional methods form microcavities and improve light emissivity, they are complex and costly. None of these methods is suitable for mass manufacturing environments where cost and efficiency are important factors. Consequently, a need still exists for a method of texturing the surface of a filament that is suitable for mass manufacturing environments.

SUMMARY OF THE INVENTION

A microchannel forming device is provided for making microchannels in a wire. The microchannel forming device includes a plurality of dice for receiving a heated wire spaced along a longitudinal axis. Each die has a circumferential surface forming an opening, and teeth projecting normally from the surface and terminating in the opening. As the heated wire is drawn through the opening of each die, the teeth engage the heated wire to form longitudinal microchannels therein.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Exemplary features of embodiments of this invention are now described with reference to the figures. It will be appreciated that the invention is not limited to the embodiments selected for illustration. Also, it should be noted that the drawings are not rendered to any particular scale or proportion. It is contemplated that any of the configurations and materials described hereafter may be modified within the scope of this invention.

Figure 1:
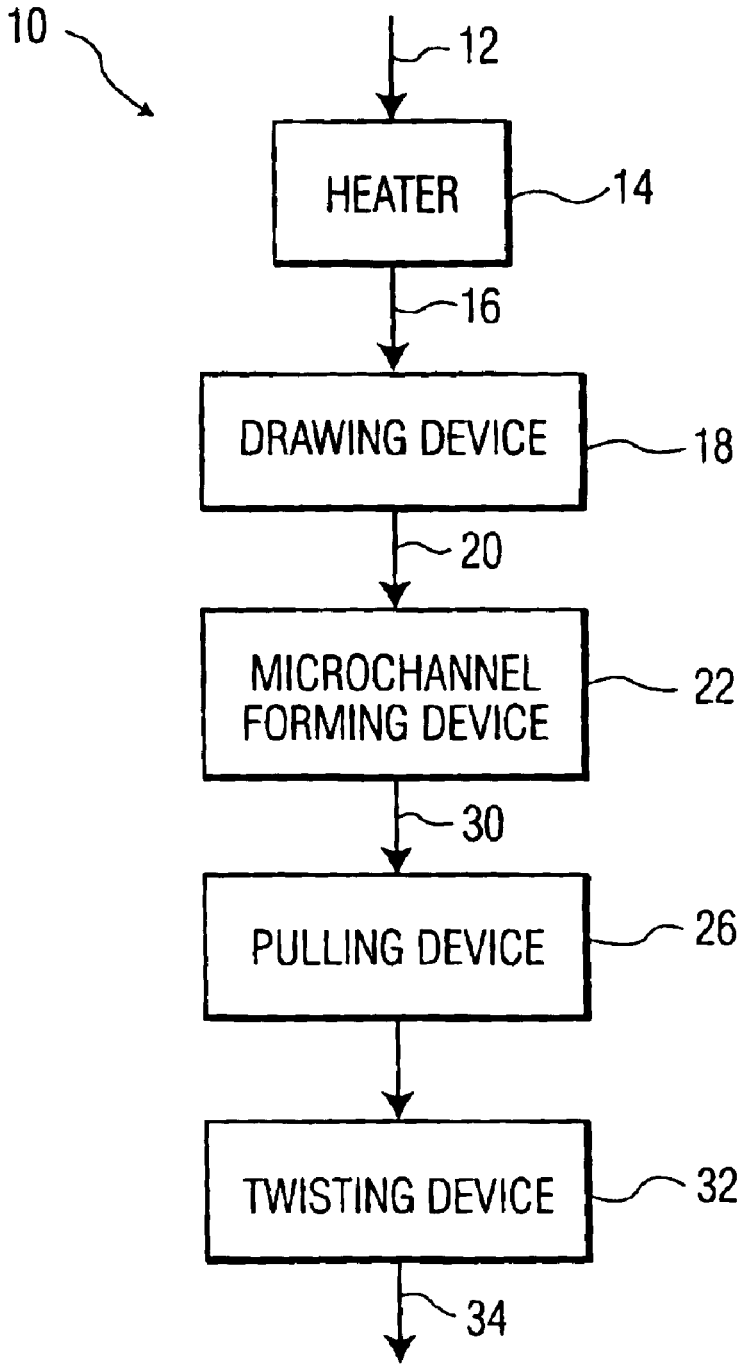
FIG. 1 is a process flow diagram of a system for making microchannels in a tungsten filament in accordance with the present invention.

Referring to FIG. 1, tungsten filament manufacturing system 10 includes heater 14, drawing device 18, microchannel forming device 22, pulling device 26, and twisting device 32. In operation, tungsten material 12 is heated by heater 14 to form heated tungsten material 16. The tungsten is heated by heater 14 to a malleable temperature (1,200° C. to 1,500° C.). The resulting tungsten material 16 is drawn, utilizing drawing device 18, to reduce the diameter of the tungsten material. The heating and drawing steps are repeated until heated tungsten wire 20 of requisite diameter, typically around 2.7 millimeters, is formed. As explained below, microchannel forming device 22 is adapted to form microchannels on the outer surface of heated tungsten wire 20. Microchanneled filament wire 30 is twisted by twisting device 32 to form twisted microchanneled filament wire 34. The present invention includes several embodiments of microchannel forming device 22, and is discussed in detail below.

Figure 2:
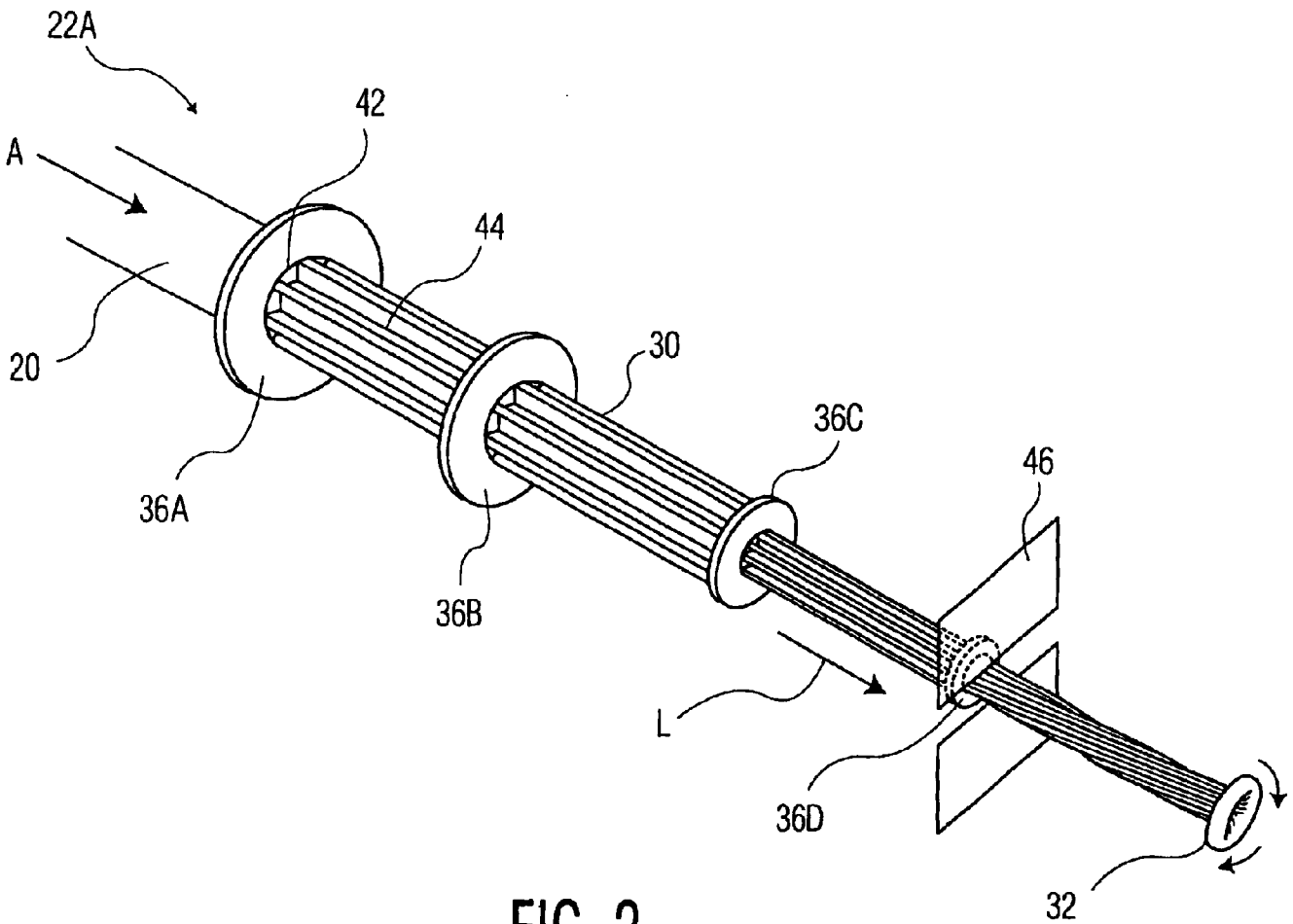
FIG. 2 is a partial perspective view of a microchannel forming device which forms a portion of the system of FIG. 1, including dice in accordance with an embodiment of the present invention.

Referring next to FIG. 2, an embodiment of microchannel forming device 22, generally designated as 22A, is illustrated. Microchannel forming device 22A includes dice 36A–36D for forming microchannels 44 in heated filament wire 20. Each die 36 includes circumferential surface 38 forming opening 40, and teeth 42 projecting normally from surface 38 (described subsequently with reference to FIG. 2A). First die 36A is positioned at a distance from drawing device 18 (not shown) and is adapted to receive heated tungsten wire 20. Dice 36A–36D are aligned along the longitudinal axis L of microchannel forming device 22A such that first die 36A receives heated filament wire 20 before second die 36B, second die 36B receives heated filament wire 20 before third die 36C, and third die 36C receives heated filament wire 20 before fourth die 36D. As shown, first die 36A is proportionately larger than second die 36B, second die 36B is proportionately larger than third die 36C, and third die 36C is proportionately larger than fourth die 36D. Teeth 42 engage heated filament wire 20 to form longitudinal microchannels 44 therein, forming microchanneled filament wire 30. Fourth die 36D includes a conventional securing device (not shown), such as a clamp, to operate in conjunction with twisting device 32. Twisting device 32 may be utilized to twist microchanneled filament wire 30 to form twisted microchanneled filament wire 34, and cutting device 46 may be utilized to cut such twisted wire 34 to specified lengths. FIG. 2 illustrates four dice 36A–36D arranged longitudinally. The present invention, however, typically includes 30 dice, spaced at various distances along the longitudinal axis.

Figure 2A:
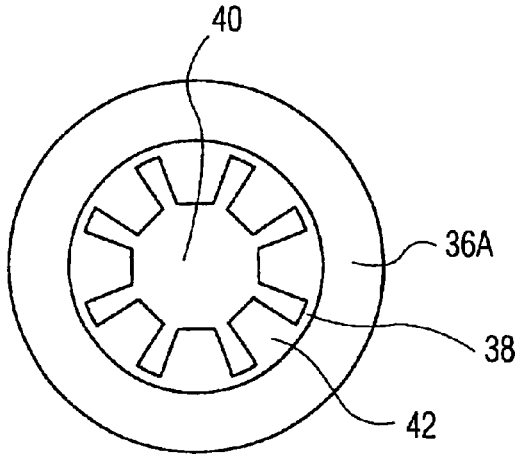
FIG. 2A is a plan detail view of a die illustrated in FIG. 2 in accordance with an embodiment of the present invention.

FIG. 2A is a detail view of first die 36A of FIG. 2. As shown, first die 36A includes circumferential surface 38 having opening 40, and teeth 42 projecting normally from surface 38. Each tooth 42 has a transverse width ranging between 5 and 100 microns, with a typical width of 20 microns. The normal height of each tooth 42 is greater than the width, typically three times the width. For clarity, FIG. 2A only shows eight teeth arranged radially from surface 38. The present invention, however, typically has 100–200 teeth arranged radially from surface 38. Dice 36B–36D are similar to that of die 36A except that each is proportionately larger than a next die disposed along the longitudinal axis. As described previously with reference to FIG. 2, first die 36A is proportionately larger than second die 36B, second die 36B is proportionately larger than third die 36C, and third die 36C is proportionately larger than fourth die 36D. Accordingly, the teeth of the first die are proportionately larger than the teeth of the second die, the teeth of the second die are proportionately larger than the teeth of the third die, and so on. In addition, the opening of the first die is proportionately larger than the opening of the second die, the opening of the second die is proportionately larger than the opening of the third die, and so on. In a typical arrangement, 30 dice are spaced along the longitudinal axis, each progressively smaller than its predecessor. In general, the last die along the axis is proportionately 50 times smaller than the first die.

Figure 3:
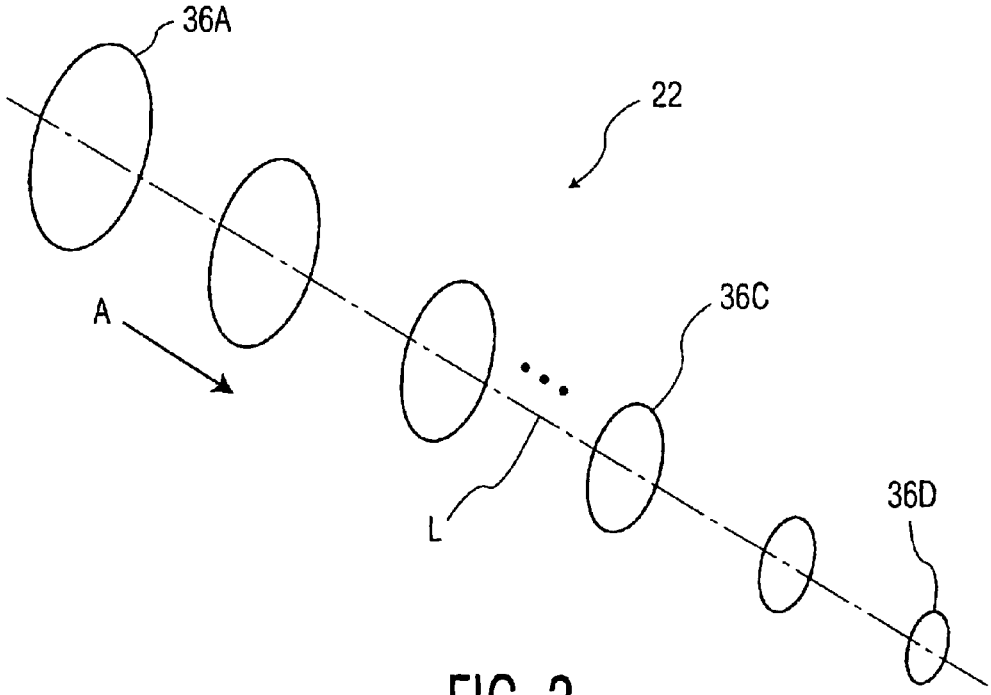
FIG. 3 is a representation of microchannel forming device further illustrating the relationship between the dice in accordance with the present invention.

FIG. 3 provides a representation of microchannel forming device 22 to further illustrate the relationship between each of the dice 36. As described previously, microchannel forming device 22 typically includes 30 dice (quantity of 6 is shown in FIG. 3) of decreasing circumference, spaced at equal distances apart from each other. It will be understood that the number of teeth 42 arranged radially from the surface of each die (illustrated in FIG. 2A) remains constant for the microchannel forming device 22 dice, while the relative dimensions of teeth 42 decrease as the circumference of each die 36 also decreases along the longitudinal axis in direction A. For example, first die 36A may have an opening diameter of 2700 microns to form a filament wire diameter of 2700 microns. Each tooth in die 36A may be 50 microns wide as an example. Accordingly, assuming a similar 50 micron spacing between teeth, there may be 85 teeth formed about the circumference of the opening (number of teeth=$\pi d/2\times$tooth width, where d is the diameter of the opening). Assuming that last die 36D may have an opening of 50 microns to form the final 50 micron size of the filament wire, and assuming a quantity of 85 teeth consistent with die 36A, the relative width of each of the teeth of die 36D may be 1 micron. Similarly, an intermediary die such as 36C may have an opening of 100 microns. Assuming a quantity of 85 teeth consistent with dice 36A and 36D, then the geometry of such a configuration yields a relative tooth width of approximately 20 microns for die 36C. These values are merely exemplary. As described previously, the present invention may have any number of dice with any number of teeth. The dice 36 become proportionately smaller along axis L in direction A.

Dice 36 may be made from tungsten or any other hardened material capable of withstanding the temperature of heated tungsten wire 20. Teeth 42 are made from WC—Co, diamond, SiC, or any other ultra-hard alloy capable of forming microchannels 44 in heated tungsten wire 20.

In operation referring to FIGS. 1–2A, heated tungsten wire 20 exits drawing device 18 and is drawn by pulling device 26 through first die 36A of microchannel forming device 22A. Teeth 42 engage heated tungsten wire 20 as it moves in direction A through first die 36A. Due to malleability from the heating process, as teeth 42 contact the surface of heated tungsten wire 20, they form microchannels 44 therein. Each microchannel 44 has a width ranging between 0.1 and 1.9 microns, with a typical width of 0.4 micron. The depth of each microchannel 44 is greater than the width, typically three times the width. The continuous movement of pulling device 26 stretches microchanneled filament wire 30, resulting in the reduced width of each microchannel 44 (typically 0.4 micron) relative to the width of each die tooth 42 (typically 20 microns). Microchannels 44 may have a square-like shape or may be V-shaped. The excess material that is removed by teeth 42 to form microchannels 44 may reform back into heated filament wire 20. Continuous movement of pulling device 26 draws microchanneled filament wire 30 through second die 36B to further reduce the diameter of microchanneled filament wire 30. Subsequently, microchanneled filament wire 30 is drawn through third die 36C and then fourth die 36D to even further reduce the diameter of microchanneled filament wire 30. The function and operation of dice 36B–36D are virtually the same as those of first die 36A, with the diameter of microchanneled filament wire 30 becoming progressively smaller. The conventional securing device (not shown) of fourth die 36D secures the movement of microchanneled filament wire 30, while twisting device 32 may be utilized to twist microchanneled filament wire 30 to form twisted microchanneled filament wire 34. Cutting device 46 may be utilized to cut such twisted wire 34 to specified lengths as desired.

Figure 4:
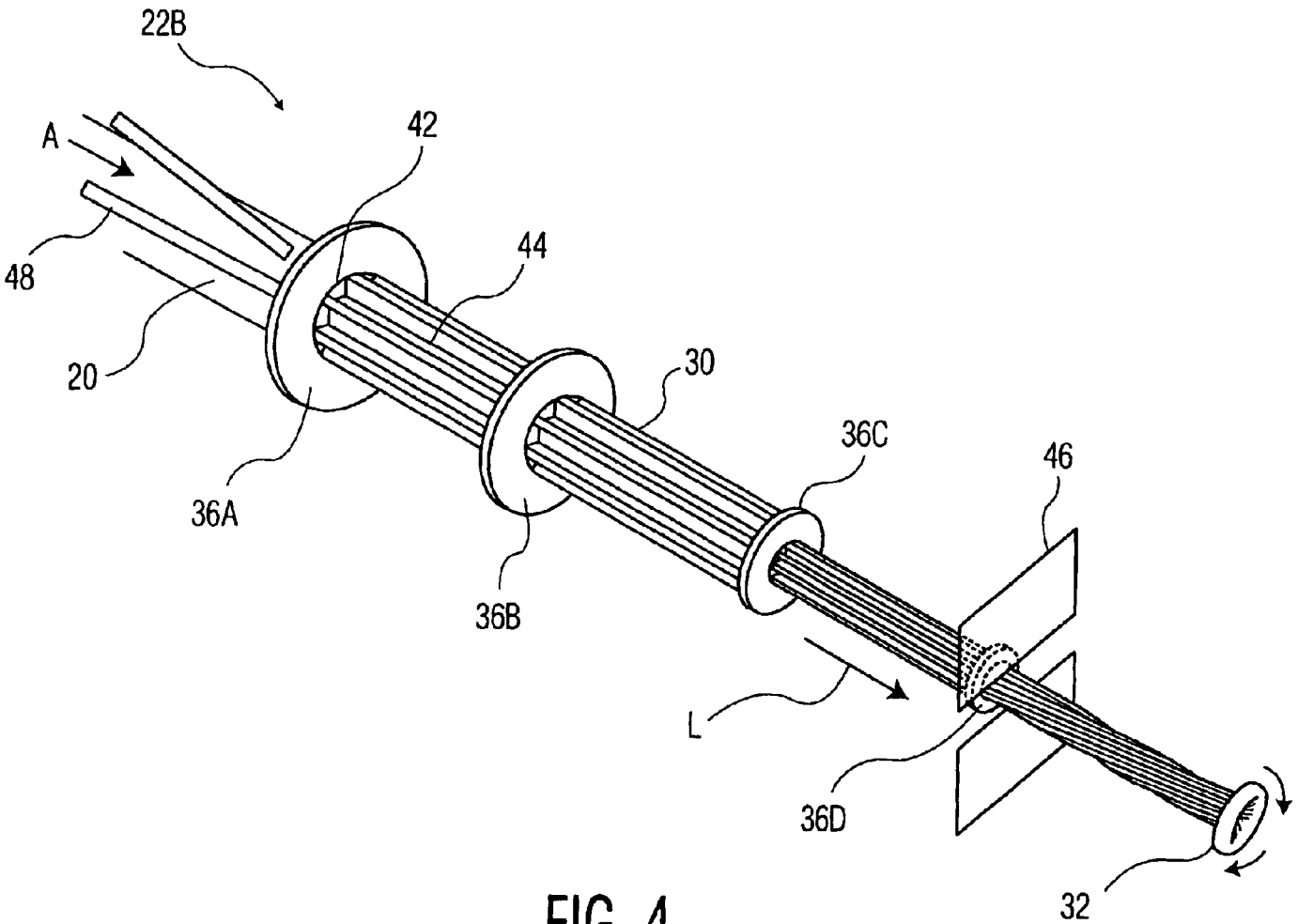
FIG. 4 is a partial perspective view of a microchannel forming device, including a die and a source of sacrificial material in accordance with another embodiment of the present invention.

Referring next to FIG. 4, another embodiment, generally designated as 22B, of microchannel forming device 22 is illustrated. The configuration and operation of microchannel forming device 22B is essentially the same as that of microchannel forming device 22A described previously with reference to FIGS. 1–2A, with one notable difference: the addition of sacrificial material 48. Similar to microchannel forming device 22A, microchannel forming device 22B includes dice 36A–36D aligned along the longitudinal axis L of microchannel forming device 22B, with each die proportionately smaller as heated filament wire 20 is drawn in direction A. Dice 36A–36D include teeth 42, and fourth die 36D includes a conventional securing device (not shown) to operate in conjunction with twisting device 32. Microchannel forming device 22B may also include cutting device 46.

Sacrificial material 48 may be made from molybdenum, tantal, rhenium, hafnium, molybdan, any combination thereof, or any other material capable of withstanding high temperatures with a lower melting point than heated tungsten filament wire 20.

Figure 4A:
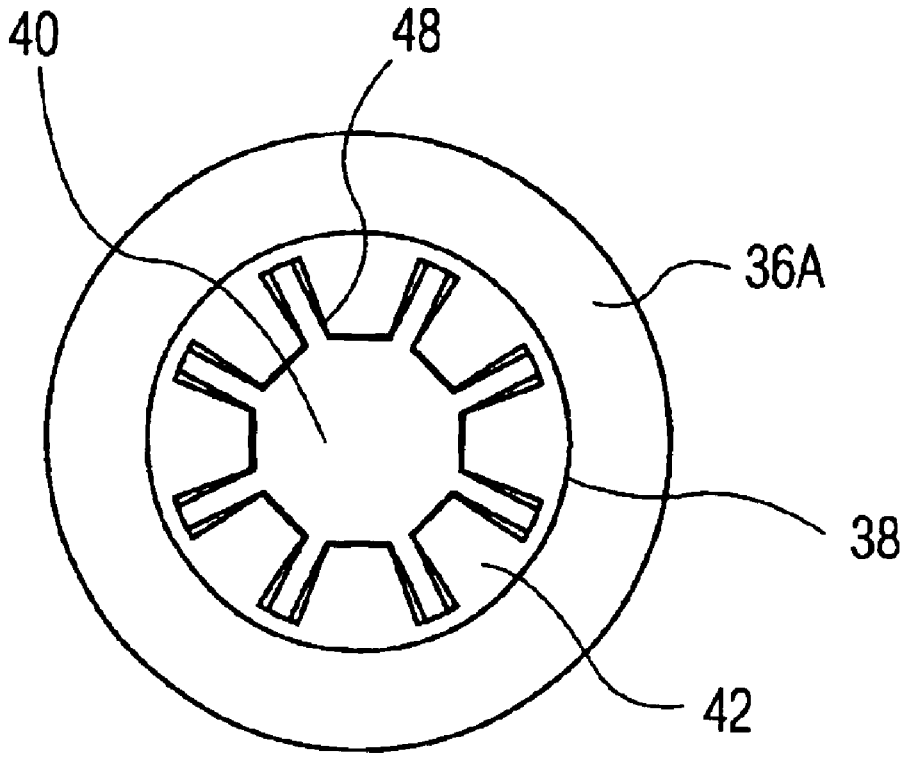
FIG. 4A is a detail view of a die illustrated in FIG. 4 in accordance with an embodiment of the present invention.

FIG. 4A is a detail view of first die 36A of FIG. 4. Similar to die 36A of microchannel forming device 22A described previously with reference to FIG. 2A, FIG. 4A illustrates circumferential surface 38 forming opening 40, and teeth 42 projecting normally from surface 38. Sacrificial material 48 coats the surfaces of teeth 42.

In operation referring to FIGS. 1, 4, and 4A, as heated tungsten wire 20 exits drawing device 18 and is drawn by pulling device 26 through first die 36A of microchannel forming device 22B, sacrificial material 48 is fed through first die 36A. Teeth 42 engage heated tungsten wire 20 as it moves in direction A through first die 36A, and sacrificial material 48 is pressed into the surfaces of formed microchannels 44. Sacrificial material 48 maintains the desired dimensional shaping of microchanneled filament wire 30 from first die 36A through fourth die 36D. After microchanneled filament wire 30 is twisted, heat is applied to melt sacrificial material 48, removing it from microchanneled filament wire 30. Similarly, a chemical etching may be used to remove sacrificial material 48 upon process completion.

The present invention provides an improvement over conventional methods of texturing the surface of a filament, as it is suitable for mass manufacturing environments where cost and efficiency are important factors. The present invention does not require complicated and costly devices, and instead utilizes simple mechanical structures to form microchannels. The present invention may also be implemented with minimum changes to a conventional filament manufacturing production line.

It will be appreciated that other modifications may be made to the illustrated embodiments without departing from the scope of the invention, which is separately defined in the appended claims.

What is claimed:

1. A microchannel forming device for making microchannels in a wire comprising:

a plurality of dice for receiving a heated wire spaced along a longitudinal axis, each die having a circumferential surface forming an opening, and teeth projecting normally from the surface and terminating in the opening, wherein as the heated wire is drawn through the opening of each die, the teeth engage the heated wire to form longitudinal microchannels therein.

2. The device of claim 1 further comprising:

a twisting device for twisting the heated wire with longitudinal microchannels formed therein.

3. The device of claim 1 wherein the plurality of dice includes a first die and a second die, the first die receiving the heated wire before the second die, and the first die being proportionately larger than the second die.

4. The device of claim 1 wherein the opening of a first die is larger than the opening of a second die, and a tooth of the first die is proportionately larger than a tooth of the second die.

5. The device of claim 1 wherein a tooth of a first die and a tooth of a second die are each radially projected from a respective surface toward a respective center of the first and second dice, and the tooth of the first die and the tooth of the second die have substantially the same radial orientation.

6. The device of claim 1 wherein each tooth has a transverse width ranging between 5 and 100 microns, and a normal height greater than the width.

7. The device of claim 6 wherein each tooth of a first die forms a longitudinal microchannel in the heated wire having a width ranging between 0.1 and 1.9 microns and a depth greater than the width, and each tooth of a second die forms a longitudinal microchannel in the heated wire having a width ranging between 0.1 and 1.0 microns and a depth greater than the width.

8. The device of claim 5 further comprising:

a source of sacrificial material for drawing through the opening of each die, wherein the sacrificial material is drawn through the first die to coat surfaces of the teeth, and is transferred onto surfaces of the microchannels.

9. The device of claim 8 wherein the sacrificial material is made of one of molybdenum, tantalum, rhenium, and hafnium, or any combination thereof.

10. The device of claim 1 wherein the wire is made of tungsten.

11. A method of forming microchannels in a wire comprising the steps of:

(a) drawing a heated wire through a plurality of dice arranged along a longitudinal axis;

(b) engaging the heated wire with teeth arranged about an opening formed by a circumferential surface in each of the plurality of dice; and (c) forming longitudinal microchannels in the heated wire, as the heated wire is drawn through the plurality of dice.

12. The method of claim 11 further comprising the step of (d) twisting the heated wire with longitudinal microchannels formed therein.

13. The method of claim 12 further comprising the step of:

(e) feeding sacrificial material through the first die to coat surfaces of the teeth; and (f) transferring the sacrificial material onto surfaces of the microchannels.

14. The method of claim 11 wherein step (b) includes pulling the wire while engaging the heated wire with teeth to form microchannels in the wire.

15. The method of claim 11 including heating material to a malleable temperature, and drawing the material to form the heated wire, prior to step (a).

16. The method of claim 11 wherein step (a) includes drawing a heated tungsten wire through a plurality of dice arranged along a longitudinal axis.

* * * * *